United States Patent [19]

Jopt et al.

[11] Patent Number: 4,495,708

[45] Date of Patent: Jan. 29, 1985

[54] DRAWING HEAD FOR A DRAWING MACHINE

[75] Inventors: Uwe Jopt, Wilhelmshaven; Hans Eder, Schortens, both of Fed. Rep. of Germany

[73] Assignee: Franz Kuhlmann Prazisionsmechanik und Maschinenbau GmbH & Co. KG, Wilhelmshaven, Fed. Rep. of Germany

[21] Appl. No.: 468,969

[22] Filed: Feb. 23, 1983

[30] Foreign Application Priority Data

Feb. 24, 1982 [DE] Fed. Rep. of Germany ..... 3206550

[51] Int. Cl.[3] ..... B43L 13/02

[52] U.S. Cl. ..... 33/438; 33/500

[58] Field of Search ..... 33/1 D, 438, 439, 440, 33/441, 442, 497, 499, 500

[56] References Cited

U.S. PATENT DOCUMENTS 3,758,953 9/1973 Bruneau ..... 33/438

FOREIGN PATENT DOCUMENTS 67584 9/1948 Denmark ..... 33/438
832867 2/1952 Fed. Rep. of Germany .
844724 7/1952 Fed. Rep. of Germany ..... 33/438
1033093 6/1958 Fed. Rep. of Germany ..... 33/438
2642424 3/1978 Fed. Rep. of Germany .
344334 3/1960 Switzerland ..... 33/438

*Primary Examiner*—Richard R. Stearns
*Attorney, Agent, or Firm*—Pearne, Gordon, Sessions, McCoy, Granger & Tilberry

[57] ABSTRACT

A drawing head for a drawing machine has a base plate with a central bore. The base plate is nonrotatably attached to the drawing machine. A rotatable straightedge support under the base plate has a central pin extending through the central bore. A nonrotatable cover plate is mounted on the pin with a gripping knob above the base plate. A spacing ring is rotatably positioned between the base plate and the cover plate. Locking devices are provided for releasably retaining the straightedge support with respect to the spacing ring and for releasably retaining the spacing ring with respect to the base plate. It is thereby possible to reduce the overall height of the drawing head while maintaining the bearing precision, and to thus achieve lower costs for production and assembly of the drawing head. Bearing means are provided whereby the central pin which engages the bore of the base plate is axially supported and rotatably positioned therein to firmly support the spacing ring. Moreover, the straightedge support is axially supported and rotatably positioned on the bearing means.

21 Claims, 3 Drawing Figures

DRAWING HEAD FOR A DRAWING MACHINE

BACKGROUND OF THE INVENTION

1. Field of the Invention

This invention relates to a drawing head for a drawing machine comprising a base plate with a central bore nonrotatably mounted to a drawing machine, a rotatable straightedge support under the base plate with a central pin extending through the central bore, a suitable nonrotatable cover plate on the pin which has a gripping knob above the base plate and cover plate, and a locking device for the underside causing releasable retention of the straightedge support with respect to the spacing ring, and a locking device for the top side causing releasable retention of the spacing ring with respect to the base plate.

2. Description of the Prior Art

Such a drawing head is shown in German Patent Specification (Offenlegungschrift) No. 26 42 424.8 (Gebrauschmuster No. 76 29 427.0), in which the central bore of the base plate has a securely countersunk bearing ring and the central pin is constructed as a pivot pin. The spacing ring is nonrotatably secured with a locking disc positioned on top, which is rotatably positioned on the central pin of the straightedge support over a tightly mounted bearing ring of the base plate in order to enable turning of the spacing ring as well as enabling the spacing ring to lock the straightedge support against the base plate, through a displacement of the spacing ring on the underside.

Through the engagement of the tightly mounted bearing ring in the central bore of the base plate, the maximum inner diameter of the base plate is reduced. The reduction of the diameter must be compensated through a lengthening (in the axial direction) of the bearings in order to achieve desired high precision in the bearing support. The manufacture of this relatively long pivot pin and bearing ring results in problems in production and installation. Moreover, studies have shown that smaller, and particularly flatter, drawing heads are easier and more convenient to use. For example, the draftsman generally attempts to constantly avoid contact with the drawing board with the hand which operates the drawing head in order to enable exact operation and braking of the drawing head.

German Pat. (Patentschrift) No. 832 867 teaches the use of a drawing head which permits only one adjustment of the upper side, i.e., it does not have a rotatable spacing ring, so that only the assembly comprising the straightedge support, the pin, and the cover plate can be rotatably positioned with respect to the base plate. The pin is constructed as a pivot pin which is positioned in the central bore of the base plate, whereby the pivot pin has a slightly larger overall length than the thickness of the base plate, and the cover plate and the straightedge support overlap the base plate as thrust or abuttment discs.

SUMMARY OF THE INVENTION

The objects of the present invention are hereby directed to the construction of a drawing head of the type generally known previously so that the total bearings have an overall height which may be reduced by maintaining a predetermined bearing tolerance exactness and which achieve a reduced production and assembly cost.

In accordance with the present invention, the problems presented by the drawing heads of the prior art are solved in that a bearing means is provided which engages the central pin which is axially supported and rotatably positioned in the bore in the base plate. The bearing means also supports the spacing ring, and the straightedge support is axially supported and rotatably positioned on the bearing means. The spacing ring can have radial graduations to accomodate other components of the drawing head.

The advantage of the invention lies particularly in the fact that the bearing surfaces between the bearing means and the base plate are located at the predetermined maximum diameter of the central bore, and that an axial support results from the bearing parts being positioned on top of each other within the predetermined radial clearance of the bearing surfaces. Thus, the axial play in the bearings is reduced and, by the resulting higher operational exactitude, a reduction in the individual bearing thicknesses, and thereby a reduction in the overall height, are made possible.

It is preferable to construct the bearing means as a disc assembly. This assembly has a first bearing disc which has about the same thickness as the base plate and which is positioned in the base plate, an intermediate thrust disc which has a larger diameter, and a second bearing disc which has the same wall thickness as the straightedge support and which carries the straightedge support. The intermediate thrust disc is provided for axial support between the base plate, the bearing means, and straightedge support. This achieves the result of limiting play in the bearing as desired when this bearing assembly is suitably axially joined.

It is also preferred that for the axial attachment of the bearing assembly, a top thrust disc on top the first bearing disc and a bottom thrust disc beneath the second bearing disc be used. The top thrust disc can be constructed as a unitary element with the spacing or graduated ring, which element extends radially around the cover plate and, for example, has an angular scale, while the cover plate, which is nonrotatably fixed with respect to the straightedge support, is provided with a corresponding vernier. One advantage of the disc assembly is that it may be easily and very precisely manufactured. Thus, additional bearing discs can be placed together concentrically. Moreover, a plurality of discs may be lapped very precisely to the desired thickness. In this manner, the bearing means may be constructed of more discs, while at the same time providing a higher level of exactness.

It is also preferable for the bearing means to contain a first brake disc of thin, elastic metal or the like, which presses against the base plate to restrain the bearing means and the spacing ring with respect to the base plate by means of an axially displaceable brake.

Likewise, it is preferable to provide a second braking disc which serves to restrain the straightedge support with respect to the bearing means and the spacing ring and which is pressed against the straightedge support by an axially displaceable brake shoe on the straightedge holder. The use of separate brake discs avoids subjecting the bearing means to an undesired stress or load which is caused when the spacing ring is braced against either the base plate or the straightedge support when the spacing ring is in either the upper braking position or the lower braking position, respectively.

The brake shoes are each supported in either the base plate or the straightedge support radially outwardly of the bearing discs and are displaceable in a direction parallel to the bearing axis within a threaded opening. The brake shoes grip with a free end around an edge of the brake disc and press the brake disc against either the base plate or the straightedge support, respectively, when the braking process is actuated. The thrust disc preferably has an outer diameter such that sufficient space for the brake shoe is provided radially outwardly beyond the thrust disc.

The first bearing disc preferably has an indented locking slot on its smooth, circumferential periphery. In the plane of the base plate, namely in a recess provided for this purpose, there is a locking element which releasably engages the locking slot in order to retain the bearing means and the spacing ring with respect to the base plate.

It is preferable also that the second bearing disc have an intended locking slot on the smooth circumferential periphery, and that a second locking element be provided in the plane of the straightedge support, which element releasably engages this locking slot to retain the straightedge support with respect to the bearing means and the spacing ring. The locking elements are provided to avoid the occurrence of undesired torque perpendicular to the bearing axis.

Through the design of the bearing means as a disc assembly, and through the simultaneous mounting of the base plate and the straightedge support relative to the bearing means, it is possible to use an identical first and second bearing disc so long as the base plate and the straightedge support have the same thickness and the same inner diameter for the central bore.

BRIEF DESCRIPTION OF THE DRAWINGS

Examples of implementation of the invention are more fully illustrated by the drawings, in which.

DETAILED DESCRIPTION OF THE PREFERRED EMBODIMENT

Figure 1:
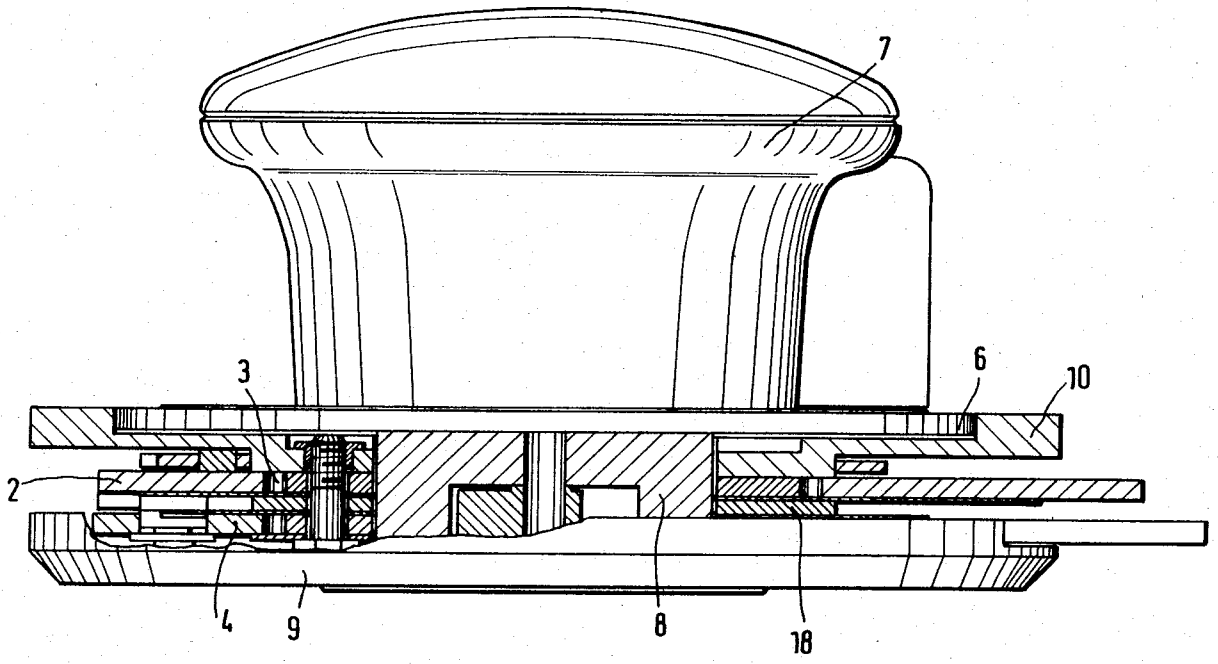
FIG. 1 is a cross section through a drawing head in accordance with the invention.

The drawing head which is shown in FIG. 1 comprises a base plate 2 which has a central bore 3 and which is secured to an intermediate member (not shown) linked to a carriage or to a parallelogram linkage of a drawing machine. A straightedge support 4 is located under the base plate 2 and is nonrotatably attached over a connecting plate 9 by means of a central pin 8 which runs through the central bore 3 of the base plate 2. The top end of the pin 8 has a cover plate 6 which has a knob 7 positioned on it. The user drives and stops the drawing head by means of the knob 7.

Between the base plate 2 and the cover plate 6 is a spacing ring 10 which is rotatably positioned on the pin 8. The spacing ring 10 turns not only relative to the base plate 2, but also relative to the assembly comprising the gripping knob 7, the cover plate 6, the pin 8, the connecting plate 9, and the straightedge support 4. The spacing ring 10 extends radially outwardly beyond the cover plate 6, and has an outer circumferential rim which extends into the plane of the cover plate 6 and surrounds the cover plate 6, and on which an angular scale, for example, is inscribed, while the cover plate 6 has a corresponding vernier. Alternatively, the vernier may be applied to the spacing ring 10, while the cover plate 6 has the angular scale. On the outer circumference of the base plate 2 at a suitable position, a second vernier is applied which cooperates well with the angular scale on the spacing ring 10 and makes possible exact positioning between the spacing ring 10 and the base plate.

Bearing means 12 surround the pin 8 and are positioned between the pin 8 and the movable straightedge support 4 and assembly 4–9 with a large clearance therebetween. The bearing means 12 are axially supported and rotatably positioned in the bore 3 of the base plate 2. The bearing means 12 is secured on the upper side by the spacing ring 10 (see FIG. 2). The straightedge support assembly 4–9 (comprising the straightedge support 4, the connecting plate 9, the pin 8, and the gripping knob 7) is rotatably positioned on the bearing means 12 and is thereby axially supported as well.

The bearing means 12 is formed as a disc assembly 14–16 and has, as a partial assembly comprising a first bearing disc 16 which is positioned in the bore 3 of the base plate 2, an intermediate thrust disc 18, below which a second bearing disc 20 is positioned and on which the straightedge support 4 is rotatably positioned. The intermediate thrust disc 18 thereby serves as an axial bracing element between the base plate 2 and the bearing means 12, as well as between the bearing means 12 and the straightedge support 4 (see FIG. 2). This partial assembly 16, 18, 20 is assembled prior to being installed in the base plate 2, and is subsequently adjusted to ensure an exactly concentric alignment of both bearing discs 16 and 20. After the installation of the partial assembly 16–20 in the base plate 2, the bearing means 12 is compled with a bottom thrust disc 22 and a top thrust disc 14, which results in additional axial support for the bearing means 12 on the base plate 2 and for the straightedge support 4 on the bearing means 12, respectively. The first bearing disc 16 and the second bearing disc 20 each have an outer diameter which is slightly less than the inner diameter of the base plate 2 and the straightedge support 4, respectively, and which is determined by the axial play of the bearings. In order to make possible economical and efficient commercial production, it is preferable that the straightedge support 4 and base plate 2 be of the same thickness so that the bearing discs 16,20 are of the same thickness as well.

The spacing ring 10 is fixedly connected with the bearing means 12 at the top of the bearing means. It is preferable that the spacing ring 10 be constructed as a unitary piece with the top thrust disc 14. The disc assembly 14–22, which supplements the spacing ring 10, is secured and fastened on by means of a bolt 23. Each bearing disc and the two adjacent thrust discs form a radially and axially precise, rigid bearing race for the base plate 2 and the straightedge support 4, which makes possible a rotatably movable support and axially fixed arrangement of the base plate 2, the bearing means 12, and the straightedge support 4. Thus, it is possible to realize a reduction of the axial bearing length through the precise axial fixed arrangement and axial support.

Figure 2:
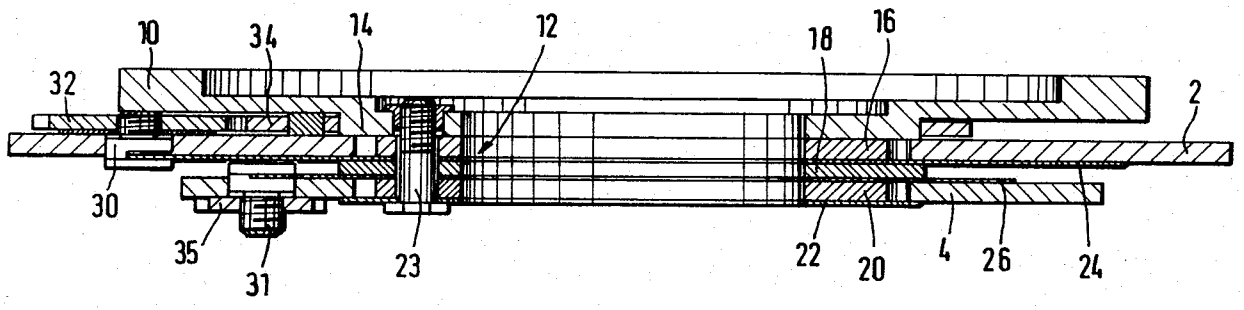
FIG. 2 is a cross section corresponding to FIG. 1 through the bearing means.

As may be seen in FIGS. 1 and 2 in particular, the bearing means 12 includes a first brake disc 24 of thin, elastic metal which is inserted between the first bearing disc 16 and the intermediate thrust disc 18. The bearing means 12 thus extends radially outwardly with the brake disc 24. The brake disc 24 extends into a slot formed in a brake shoe 30, which is axially movable within an axially aligned, threaded opening in the base plate 2 and which supports a pinion 32 on its upper end. The pinion 32 is rotatable by means of an operational element 34, and thereby the brake disc 24 presses against the base plate 2 and locks it.

The bearing means 12 also includes a second brake disc 26 which is located between the intermediate thrust disc 18 and the second bearing disc 20, and extends radially into the slot formed in a second brake shoe 31 which is axially movably supported on the straightedge support 4 by means of a threaded opening. The brake shoe 31 supports a pinion 33 (FIG. 3) on its lower end which is rotatable by means of an operational element 35. Through the rotation of the second brake shoe 31, the second braking disc 26 is pressed against the straightedge support 4. In this manner, the straightedge support 4 is locked against the bearing means 12 and the spacing ring 10. The starting discs 14,18 have a suitable thickness which results in large enough intervals radially outwardly of the thrust discs 14,18 between the spacing ring 10 and the base plate 2 and the straightedge support 4, respectively, so that the brake shoes 30,31 suitably grip the brake discs 24,26.

Figure 3:
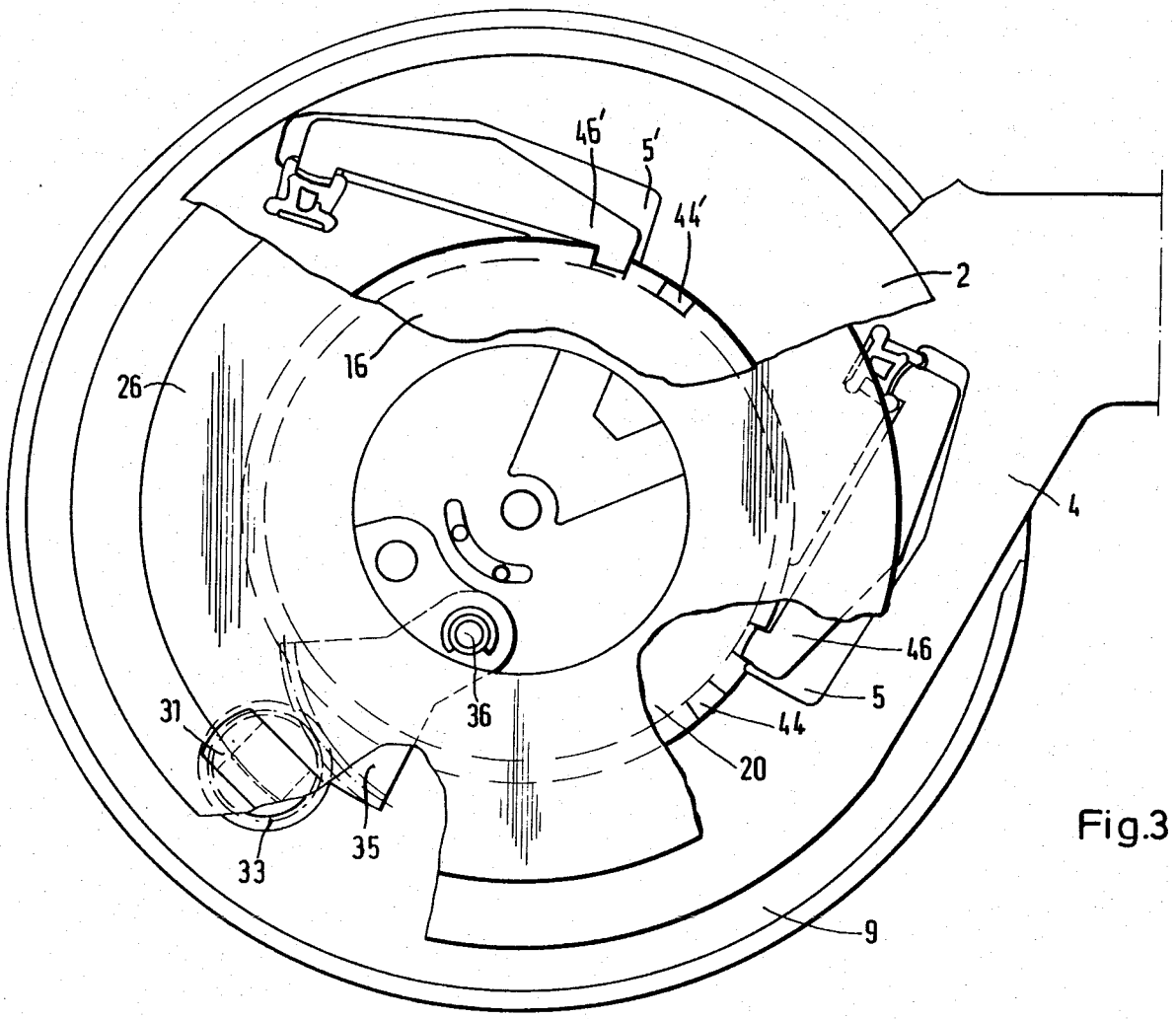
FIG. 3 is a cross section along line A–B of FIG. 1.

As is shown in particular in FIG. 3, the second bearing disc 20 has one or more circumferential locking slots 44 on the smooth outer periphery. A locking element 46 is positioned in a recess 5 formed in the straightedge support 4, located in the plane of the straightedge support 4. The locking element 46 releasably retains the straightedge support 4 relative to spacing ring and bearing means 10,12 as it engages one of the locking slots 44. In a corresponding manner, the first bearing disc 16 has one or more circumferential locking slots 44' in its smooth outer periphery. In a recess 5' formed in the base plate 2, a second locking element 46' is positioned in the plane of the base plate 2 which engages one of the locking slots of the first bearing disc to cause the releasable retention of the spacing ring and bearing means 10,12 relative to base plate 2. Inasmuch as the locking slots 44 are provided on the entire circumference of the first bearing disc 16, it is in this manner possible to halt the spacing ring and bearing means in relation to the base plate 2 in predetermined steps. In the alternative, it is possible to provide a locking slot only at the initial position between the spacing ring and bearing means 10,12, and the base plate 2 so that releasable locking is only possible in this initial position and retention intermediate steps is only possible through the release of this locking point and subsequent braking operations using the brake shoes 30.

The locking element 46 and the brake shoe 31 in the straightedge support 4 are activated by transmission elements 35,36 which operate between the straightedge support 4 and the connecting plate 9. The transmission elements can be activated by the operational elements which are positioned in the gripping knob 7 and are operated within the pin 8.

The straightedge support 4 and the base plate 2 have the same wall thickness and the same inner diameter at the central bore 3 in the represented embodiment. The first and the second bearing discs 16,20 also have the same thickness, and therefore in an assembly of 30 or more discs, for example, may slide around and subsequently be lapped together as a unit having the desired total thickness but which includes a predetermined amount more play or bearing space than the combined thickness of the base plate 2 and the straightedge support 4. Consequently, the first bearing disc 16, the intermediate thrust disc 18, and the second bearing disc 20 are assembled prior to mounting in the base plate and stamped or pressed together to form an assembly. After the installation of the partial assembly 16–20 in the base plate 2, the spacing ring 10 with integrated thrust discs 14 is placed on the partial assembly 10. Further, the straightedge support 4 and the bottom thrust disc 22 are added and pressed together with the partial assembly and fastened together by the bolt 23.

While the invention has been shown and described with respect to a particular embodiment thereof, this is for the purpose of illustration rather than limitation, and other variations and modifications of the specific embodiment herein shown and described will be apparent to those skilled in the art all within the intended spirit and scope of the invention. Accordingly, the patent is not to be limited in scope and effect to the specific embodiment herein shown and described nor in any other way that is inconsistent with the extent to which the progress in the art has been advanced by the invention.

What is claimed is:

1. A drawing head:

a base plate adapted to be attached to the drawing machine, the base plate having a central bore;

a straightedge support adjacent to the base plate and rotatable with respect to the base plate;

a central pin which extends through the central bore and being operatively connected with the straightedge support;

a cover plate attached to the pin;

a gripping handle attached to the pin and projecting above the cover plate;

a spacing ring rotatably mounted between the base plate and the cover plate;

first locking means for releasably retaining the straightedge support with respect to the spacing ring;

second locking means for releasably retaining the spacing ring with respect to the base plate; and bearing means which are rotatably surrounding the central pin and which are rotatably mounted in the bore of the base plate and which are rotatable with the spacing ring, the straightedge support being axially supported and rotatably positioned on the bearing means.

2. A drawing head as set forth in claim 1, comprising in addition:

a thrust element which is axially supported on the bearing means and which extends radially outwardly between the base plate and straightedge support.

3. A drawing head as set forth in claim 1, wherein the bearing means includes a disc assembly comprising a top thrust disc, a first bearing disc positioned in the base plate and having substantially the same thickness as the base plate, an intermediate thrust disc, a second bearing disc positioned in the straightedge support and having substantially the same thickness as the straightedge support, and a bottom thrust disc.

4. A drawing head as set forth in claim 3, wherein the first locking means comprises a first bearing disc having at least one locking slot on its circumference and a locking element is provided in the plane of the base plate which releasably engages the locking slot to fix the bearing means and spacing ring with respect to the base plate.

5. A drawing head as set forth in claim 3, wherein the second locking means comprises a second bearing disc having at least one locking slot on its circumference, and a locking element is positioned in the plane of the straightedge support which releasably engages the locking slot to fix the straightedge support with respect to the bearing means and the spacing ring.

6. A drawing head as set forth in claim 3, wherein the straightedge support and the base plate have substantially the same thickness and the same inner diameter, and the first and second bearing discs have substantially the same thickness and the same outer diameter.

7. A drawing head as set forth in claim 3, wherein the spacing ring is formed as a unitary piece with top thrust disc.

8. A drawing head as set forth in claim 1, wherein the spacing ring is connected with the bearing means.

9. A drawing head as set forth in claim 1, wherein the bearing means includes a first braking means comprising a first braking disc of thin metal which is used for retaining the base plate relative to the bearing means and the spaceing ring, and a first brake shoe which presses the first braking disc against the base plate.

10. A drawing head as set forth in claim 9, wherein the first braking disc is located between the first bearing disc and the intermediate thrust disc.

11. A drawing head as set forth in claim 9, wherein the bearing means has second braking means comprising a second braking disc for retaining the straightedge support relative to the bearing means and the spacing ring, and a second brake shoe which presses the second braking disc against the straightedge support.

12. A drawing head as set forth in claim 9, wherein the first brake shoe is displaceably mounted substantially parallel to the bearing axis and the top thrust disc has a thickness such that the spacing between the spacing ring and the base plate radially outwardly of the thrust disc is sufficient to accommodate the first brake shoe which engages the first brake disc.

13. A drawing head as set forth in claim 9, wherein the first locking means comprises a first bearing disc having at least one locking slot on its circumference and a locking element is provided in the plane of the base plate which releasably engages the locking slot for halting the bearing means and spacing ring with respect to the base plate.

14. A drawing head as set forth in claim 13, including transmission means which operate the locking element and the brake shoe, and the gripping handle operates the transmission means.

15. A drawing head as set forth in claim 1, wherein the bearing means has second braking means comprising a second braking disc for retaining the straightedge support relative to the bearing means and the spacing ring, and a second brake shoe which presses the second braking disc against the straightedge support.

16. A drawing head as set forth in claim 15, wherein the second brake disc is located between the intermediate thrust disc and the straightedge support.

17. A drawing head as set forth in claim 15, wherein the second brake shoe is displaceably mounted substantially parallel to the bearing axis, and the intermediate thrust disc has a thickness such that the spacing between the base plate and the straightedge support radially outwardly of the starting disc is sufficient to accommodate the second brake shoe which engages the second braking disc.

18. A drawing head as set forth in claim 15, wherein the second locking means further comprises a second bearing disc having at least one locking slot on its circumference, and a locking element is positioned in the plane of the straightedge support which releasably engages the locking slot for stopping the straightedge support with respect to the bearing means and the spacing ring.

19. A drawing head as set forth in claim 18, including transmission means which operate the locking element and the brake shoe, and the gripping handle operates the transmission means.

20. A drawing head as set forth in claim 1, comprising in addition a thrust disc being provided at the bearing means for axially supporting the bearing means against the base plate, and which extends radially outwardly between the base plate and straightedge support.

21. A drawing head as set forth in claim 1, wherein the spacing ring includes radial graduations.

* * * * *

UNITED STATES PATENT AND TRADEMARK OFFICE

CERTIFICATE OF CORRECTION

PATENT NO. : 4,495,708

DATED : January 29, 1985

INVENTOR(S) : Uwe Jopt, et al.

It is certified that error appears in the above—identified patent and that said Letters Patent is hereby corrected as shown below:

Column 4, line 32, "compled" should read --completed--.

Signed and Sealed this

*Second* Day of *July 1985*

[SEAL]

*Attest:*

DONALD J. QUIGG

*Attesting Officer* *Acting Commissioner of Patents and Trademarks*